US006446606B1

(12) United States Patent
Krimmer et al.

(10) Patent No.: US 6,446,606 B1
(45) Date of Patent: Sep. 10, 2002

(54) METERING UNIT FOR A FUEL INJECTION SYSTEM FOR INTERNAL COMBUSTION ENGINES

(75) Inventors: Erwin Krimmer, Pluederhausen; Rainer Haeberer, Bretten; Helmut Clauss, Eberdingen; Tilman Miehle, Kernen; Felix Laudaeusser, Wernau; Markus Rueckle, Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,418

(22) PCT Filed: Jun. 25, 1999

(86) PCT No.: PCT/DE99/01848

§ 371 (c)(1),
(2), (4) Date: Aug. 25, 2000

(87) PCT Pub. No.: WO00/29742

PCT Pub. Date: May 25, 2000

(30) Foreign Application Priority Data

Nov. 18, 1998 (DE) ..... 198 53 103

(51) Int. Cl.[7] ..... F02M 41/00
(52) U.S. Cl. ..... 123/458; 123/446; 251/129.07
(58) Field of Search ..... 123/446, 458, 123/516, 462, 459; 251/129.07, 129.08

(56) References Cited

U.S. PATENT DOCUMENTS

| | | | | | |
|---|---|---|---|---|---|
| 3,797,235 | A | * | 3/1974 | Eheim | 60/39.281 |
| 4,462,372 | A | * | 7/1984 | Jackson | 123/452 |
| 5,092,299 | A | * | 3/1992 | Muntean et al. | 123/462 |
| 5,639,066 | A | * | 6/1997 | Lambert et al. | 251/282 |
| 5,791,318 | A | * | 8/1998 | Schulz et al. | 123/520 |

FOREIGN PATENT DOCUMENTS

| | | | |
|---|---|---|---|
| DE | 19549108 | * | 7/1997 |
| EP | 0778413 | * | 6/1997 |

* cited by examiner

*Primary Examiner*—Carl S. Miller
(74) *Attorney, Agent, or Firm*—Ronald E. Greigg

(57) ABSTRACT

A fuel injection system for internal combustion engines, has a distributor tube and a high-pressure pump that is driven as a function of engine rpm and that serves to generate the fuel pressure and throughput required in the distributor tube in the applicable operating state of the engine. The system also includes a fuel metering unit, which is associated with the high-pressure pump and includes a regulating valve which is actuated electromagnetically. The fuel metering unit is disposed in the high-pressure pump, and the outlet of the regulating valve discharges into the low-pressure region of the high-pressure pump. The above design features make a fuel metering unit possible that is capable of metering the exact quantity of fuel desired in the applicable engine operating state to the high-pressure pump of the CR system.

12 Claims, 5 Drawing Sheets

METERING UNIT FOR A FUEL INJECTION SYSTEM FOR INTERNAL COMBUSTION ENGINES

PRIOR ART

The invention relates to a fuel injection system for internal combustion engines.

As general prior art in this field, European Patent Disclosure EP 0 299 337 and German Patent Disclosure DE 195 49 108.4 are cited—as examples.

In particular, the invention is based on a so-called common rail system (CR system). The special feature of such CR systems is that the requisite fuel quantity has to be brought by a high-pressure pump to a variable pressure that is dependent on the applicable engine operating state. The high-pressure pump is driven as a function of the engine rpm, which can be done by cam shaft drive, for instance. The possible feed quantity of the high-pressure pump is designed such that in every operating state, an excess quantity of fuel, that is, more than is needed by the rail for the desired pressure buildup, can be pumped.

It is known for the fuel to be metered to the rail on the basis of a pressure regulating valve that is disposed in the high-pressure region downstream of the high-pressure pump. By means of this pressure regulating valve, the high-pressure fuel stream is split, on the one hand in the direction of the rail to increase/maintain pressure, and on the other in the direction of the fuel tank. This latter fractional stream is the overflow quantity, which at the same time means an attendant loss of efficiency.

In the present state of the art in CR systems, high-pressure fuel is accordingly diverted by the pressure regulating valve. This leads to high fuel temperatures and poor efficiency. Furthermore, the wide fuel temperature range in operation with a pressure regulating valve, dictated by the temperature-dependent density, leads to fluctuating injection quantities, which can be only partially compensated for by way of a temperature compensation by means of a temperature sensor.

ADVANTAGES OF THE INVENTION

By means of the system according to the invention, for a CR system of the type in question, a fuel metering unit is created that is capable of metering exactly the desired fuel quantity in the applicable engine operating state to the high-pressure pump of the CR system. By this kind of exact metering, of the requisite fuel quantity to the high-pressure pump, the unnecessary fuel overflow quantities that occur in previous fuel injection system prior art are averted from the very outset. This leads to improved efficiency and thus to fuel economies.

DESCRIPTION OF THE EXEMPLARY EMBODIMENTS

Figure 1:
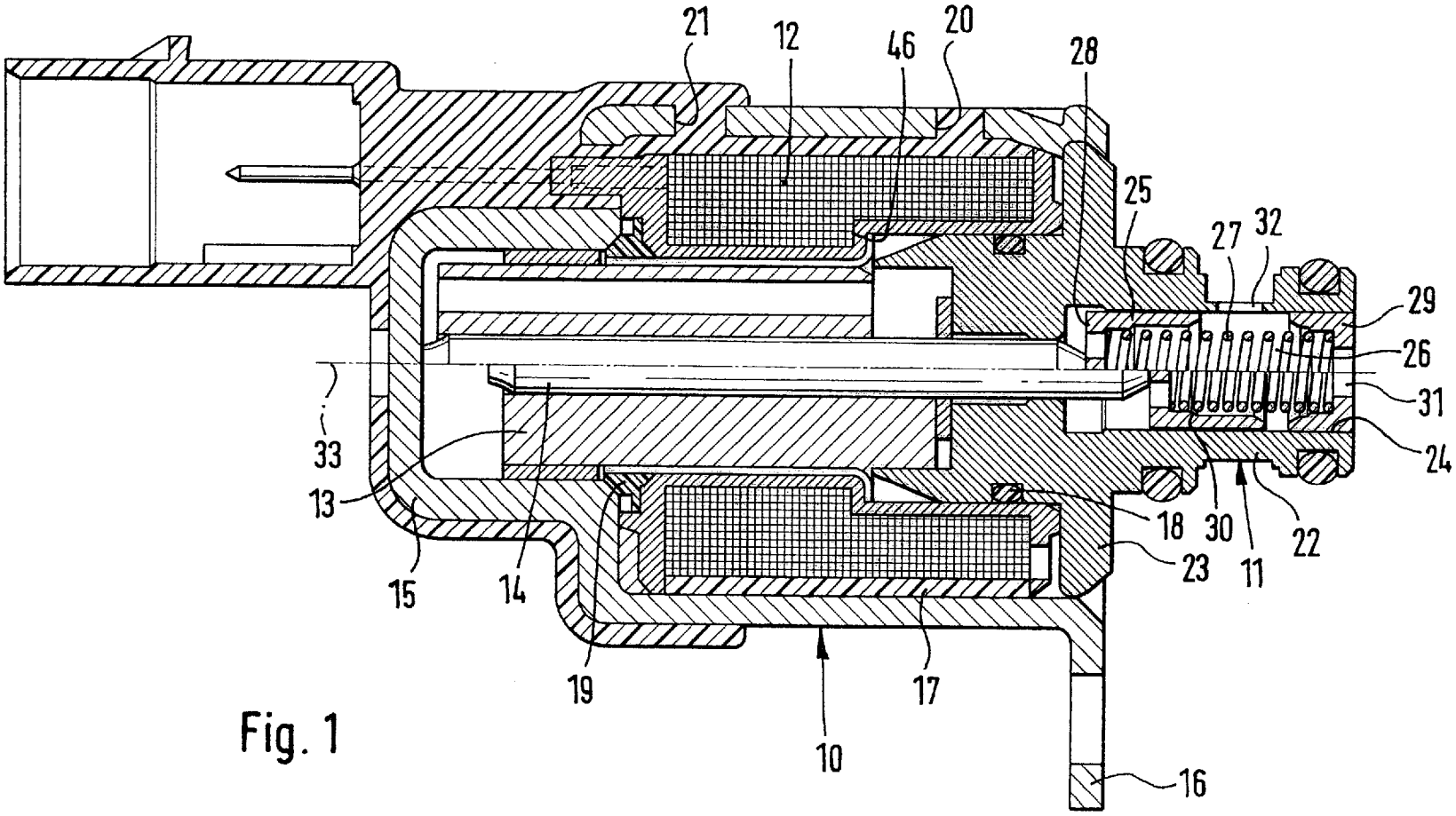
FIG. 1, an embodiment of a fuel metering unit, in vertical longitudinal section.

The fuel metering unit of FIG. 1 is based on an electromagnet 10 with an integrated regulating valve 11. Specifically, the electromagnet 10 substantially comprises a magnet, coil 12, an armature 13 with an armature bolt 14, and a magnetic housing 15 that partly surrounds the magnetic oil and the armature 13.

The entire structural unit of the electromagnet 10 with the integrated regulating valve 11 is disposed in a high-pressure fuel pump (not shown). The magnetic housing 15 simultaneously serves as a sealing element and as a magnetic short circuit, and has a fastening element 16 integral with the housing that helps to mount the electromagnet 10 in the high-pressure pump.

The magnet coil 12, once it is inserted into the magnet housing 15, is spray-coated completely. The spray coating 17 assures an optimal heat transfer from the coil 12 to the housing 15. Overheating in critical operating states can be counteracted as a result. The spray coating 17 also leads to good resistance to vibration and shaking, thus enabling the fuel metering unit 10, 11 to be mounted heavily stressed locations, for instance in the high-pressure fuel pump without being adversely affected by high vibration and temperature or by other environmental stresses.

Also by means of the spray coating 17 of the magnet coil 12, in cooperation with two seals 18, 19, it is assured that the contact points of the coil 12 with the plug lugs (not shown) always remain dry.

The magnet coil winding and contact points are thus optimally protected against attack by corrosive media.

In order to check that the spray coating 17 completely encloses the magnet coil 12, "overflow bores" 20, 21 are provided on the circumference of the magnetic housing 15.

The regulating valve 11 has a valve housing 22, which changes into a flangelike widened portion 23 that at the same time forms the face-end termination of the housing 15. The valve housing 22 has an axial bore 24 that is coaxial with the armature bolt 14 of the electromagnet 10. The axial bore 24 receives a displaceable, sleevelike valve piston 25, and a compression spring 27. The compression spring 27 is supported on its front end on a bottom 28 of the valve piston 25 and on its rear end on a spring plate 29 located in the axial bore 24 of the valve housing 22. A shoulder 30 on the inner wall of the valve piston 25 assures that the compression spring 27 rests in the valve piston 25 in such a way that it is substantially free of contact with the inner wall of the axial bore 24. On the outside, the valve piston bottom 28 and the thus the valve piston 25 are in contact with the rear end of the armature bolt 14.

An opening 31 connects the interior 26 of the valve piston 25 with a prefeed pump of the fuel injection system. Also disposed in the valve housing 22 are a plurality of radially oriented control openings (see also FIGS. 2–4), of which one is visible in FIG. 1 and is identified by reference numeral 32. The control opening 32 is in operative hydraulic communication with the low-pressure region of the high-pressure pump (not shown).

The flow principle can also be reversed. In that case, the opening 31 would communicate hydraulically with the low-pressure region of the high-pressure pump, while the control opening 32 would communicate with the compression side of the prefeed pump and would thus form the inlet into the metering unit.

The upper half of FIG. 1, above the common center axis 33 of the valve bore 24, valve piston 25 and armature bolt 14, shows the regulating valve 11 in the open position, in which the control opening 32 is completely uncovered by the valve piston 25. In the lower half of FIG. 1, conversely, the regulating valve 11 is shown in the completely closed position. The magnet force of the electromagnet 10, to which electric current is supplied, acts via the armature bolt 14 on the valve piston 25 and moves it into the aforementioned closed position of the regulating valve 11 counter to the resistance of the compression spring 27. Conversely, the compression spring 27 can displace the valve piston 25 into the open position (upper half of FIG. 1) when the electric current supplied to the electromagnet 10 and thus its magnetic force acting on the armature 13 and armature bolt 14 are correspondingly reduced. In the open position of the regulating valve 10, the fuel supplied at 31 to the regulating valve 11 flows through the control opening 32 in the direction of the elements of the high-pressure pump.

Figure 2:
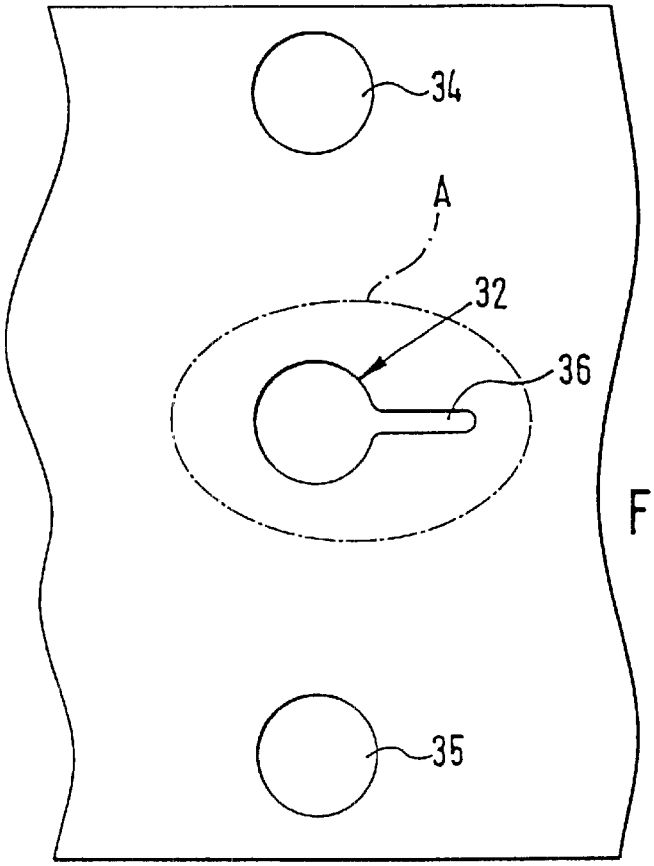
FIG. 2, a variant of the openings of a regulating valve of the fuel metering unit of FIG. 1 showing three control openings.
Figure 3:
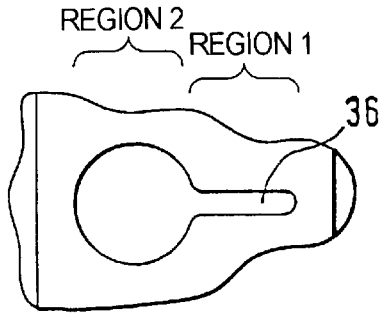
FIG. 3, detail "A" of FIG. 2.

As already indicated above, it has proved expedient in practice to provide not merely one but rather a plurality of radial control openings, distributed over the circumference of the valve housing 2. FIG. 2 shows a variant in which a total of three control openings—designated 32, 34 and 35—are provided. As seen from FIG. 3, the special design of the middle control opening 32 results in two control regions of the regulating valve 11, specifically a region 1 of correspondingly slight fuel feeding and a region 2 of linearly sharply rising fuel feeding (see FIG. 4), as a function of the valve piston stroke. Region 1 (slight fuel feeding) is associated with the range of engine idling up to lower partial load. Region 2 (sharply rising fuel feeding) conversely corresponds to middle partial load up to full load of the engine. Region 1 is accordingly distinguished by the fact that initially only the opening area of the slitlike part 36 of the control opening 32, plotted over the stroke of the valve piston 25 (or of the armature bolt 14), has a shallow characteristic curve. This characteristic curve is marked 37 in FIG. 4. As a result, good regulation of idling and lower partial load of the engine is possible. This is achieved by means of the narrow, rounded-end design of the slitlike part 36 of the control opening 32. This narrow slit 36 can be produced by erosion, stamping or laser cutting.

Figure 4:
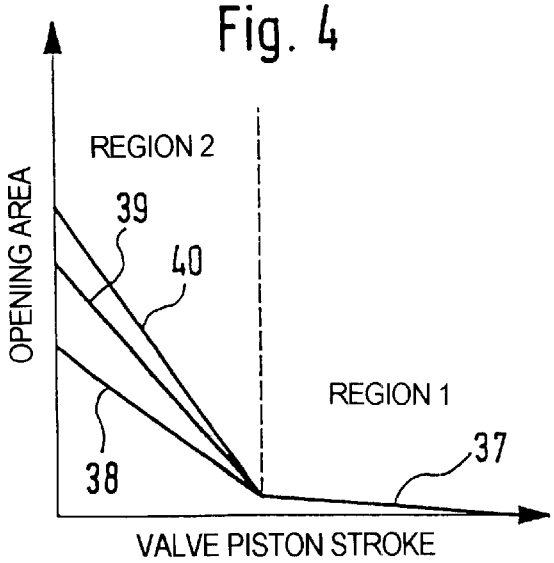
FIG. 4, a graph in which the opening area of the control opening of FIG. 3 is plotted over the magnet stroke.

Region 2 is distinguished in that the opening area—in this case of all three involved control openings 32, 34 and 35 (FIG. 2)—plotted over the stroke of the valve piston 25 or of the armature bolt 14 has a steep characteristic curve; see the curve segments 38, 39 and 40 in FIG. 4. This assures that after a defined stroke, a suitably large opening area is available. This makes a short structural length and low energy consumption of the electromagnet 10 possible.

As an alternative to the variant seen in FIG. 2 with three circular control openings 32, 34, 35, large control opening areas can also be realized by means of a suitably wide slit or a control opening of suitably large diameter, or by a plurality of slits or bores of suitable geometry (for instance a triangular shape) distributed over the circumference of the valve housing 22.

The fuel metering unit in question can be used generally for various types of vehicle (passenger cars, utility vehicles, special vehicles, ships, and so forth), as long as they are operated by internal combustion engines. The requisite adaptation can be accomplished in a simple way by the design of the opening areas of the valve control openings (such as 32, 34, 35 in FIG. 2).

As already mentioned and as seen in FIG. 1, the regulating valve 11 is integrated with the housing 15 of the electromagnet 10, and the complete fuel metering unit 10, 11 is mounted into the high-pressure pump. This guarantees an optimally small structural space and economical manufacture. The minimal idle volume attainable as a result assures exact metering of whatever fuel quantity is required at a given time as well as fast reaction times to a changing quantitative demand by the high-pressure pump or the engine.

Figure 5:
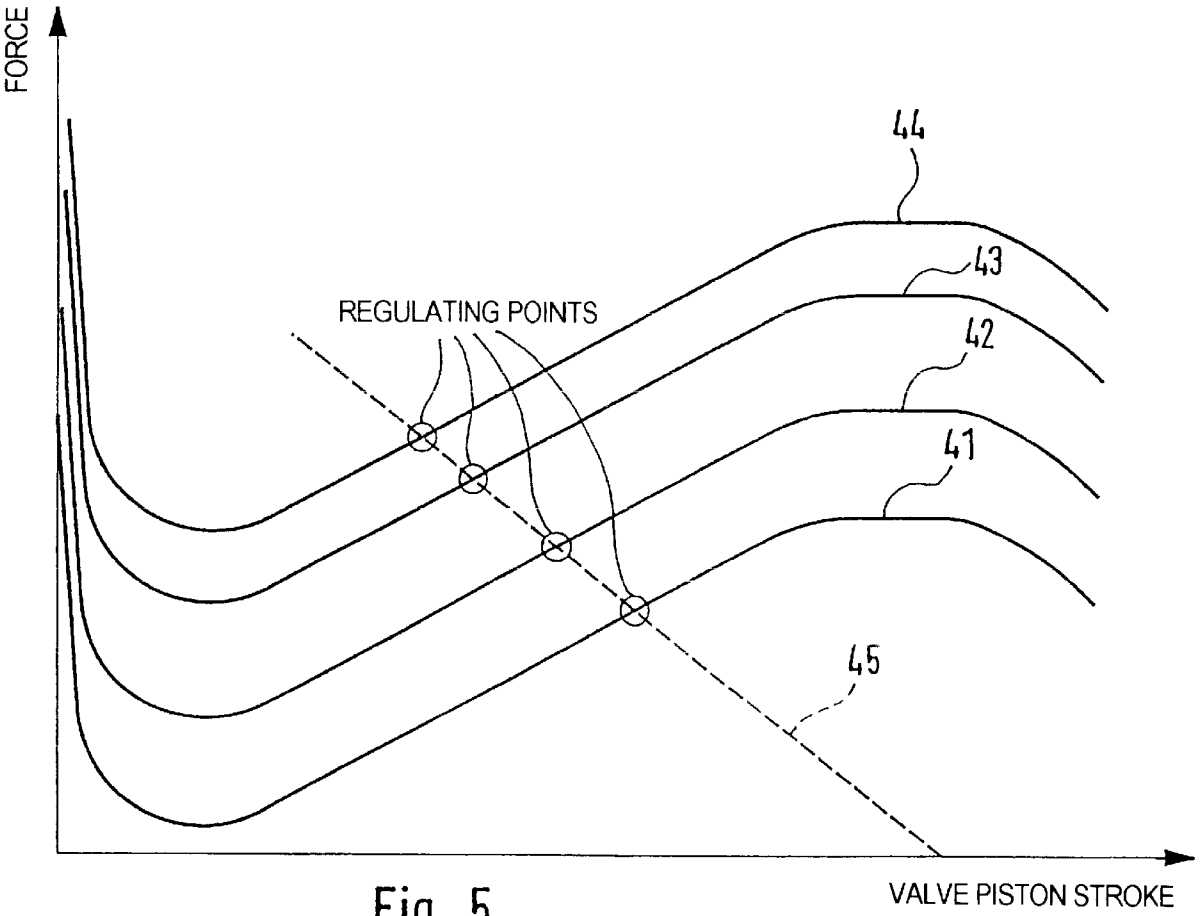
FIG. 5, a graph showing the characteristic curves of the electromagnet and of a compression spring that actuates the regulating valve.

From the above remarks it will already be clear that for a fuel metering unit the capability of exact regulation is important. This demand is met here by the provisions described below. First, for this purpose, it proves to be highly expedient to design the characteristic curve of the electromagnet 10 as contrary to the characteristic curve of the compression spring 27. FIG. 5 shows four parallel magnet characteristic curves 41–44 with different magnet currents as parameters. The spring characteristic curve (shown in dashed lines) is marked 45. Regulating points are obtained at each of the intersections of the spring characteristic curve 45 with the magnet characteristic curves 41–44. This characteristic curve association is achieved by means of a special magnet core geometry as well as optimized thicknesses of material at the magnet armature 13 and at the magnet housing 15. High spring stiffness (a high c value of the compression spring 27) is advantageous. As a result, suitably steep transitions between the magnet characteristic curve (41 or 42 or 43 or 44) and the spring characteristic curve 45 are achieved. This leads to stable regulating points.

An optimized design of the electrical characteristic values (inductance, wire thickness, number of windings of the magnet coil 12) and of the magnet circuit make highly accurate functioning of the fuel metering unit possible even at minimal battery voltages.

The triggering of the electromagnet 10 is done in pulse width modulated fashion. An optimized trigger frequency causes rippling motions of the magnet armature 13 and thus of the valve piston 25. These provisions lead to reduced frictional hysteresis and good dynamics of the fuel metering unit.

Before the fuel metering unit 10, 11 is put into operation, an adjustment of the regulating valve 11 is required. This is done by suitable axial displacement of the spring plate 29 in the valve bore 24 and ensuing fixation of the spring plate. Specifically, the adjustment operation is performed as follows. First, the electromagnet 10 is acted upon by a defined current. Next, the spring plate 29 is inserted into the valve bore 24 far enough that a defined volumetric flow results from the control opening (such as 32 in FIG. 1). In this position, the spring plate 29 is fixed, for example by it being positioned accurately during it being press-fitted. Alternatively, the spring plate can be positioned and then the valve housing 22 is deformed plastically from outside. This valve adjustment point is suitably placed in the region of minimum fuel flow quantities, so that for the idling range, which is vulnerable to tolerances, the positioning of the spring plate can be adjusted to as exact as possible.

To optimize the magnet force, the magnet coil 12 is designed with a shoulder 46. As a result, the internal structural space of the electromagnet 10 can be optimally utilized. The working air gap of the electromagnet 10 has been placed in the center of the coil 12, for the sake of optimizing the magnet force. Because of the contact-free guidance of the compression spring 27 in the interior of the valve piston 25, the hystereses of the spring and magnet can be kept at a minimal level, so that exact fuel metering is assured.

The entire regulating valve 11 and electromagnet 10 are fuel-flooded. The regulating valve 11 is thus hydraulically balanced. Interfering factors do not affect the metering. The flooded electromagnet 10 acts as a hydraulic cushion that counteracts both interfering factors and wear from friction.

Figure 6:
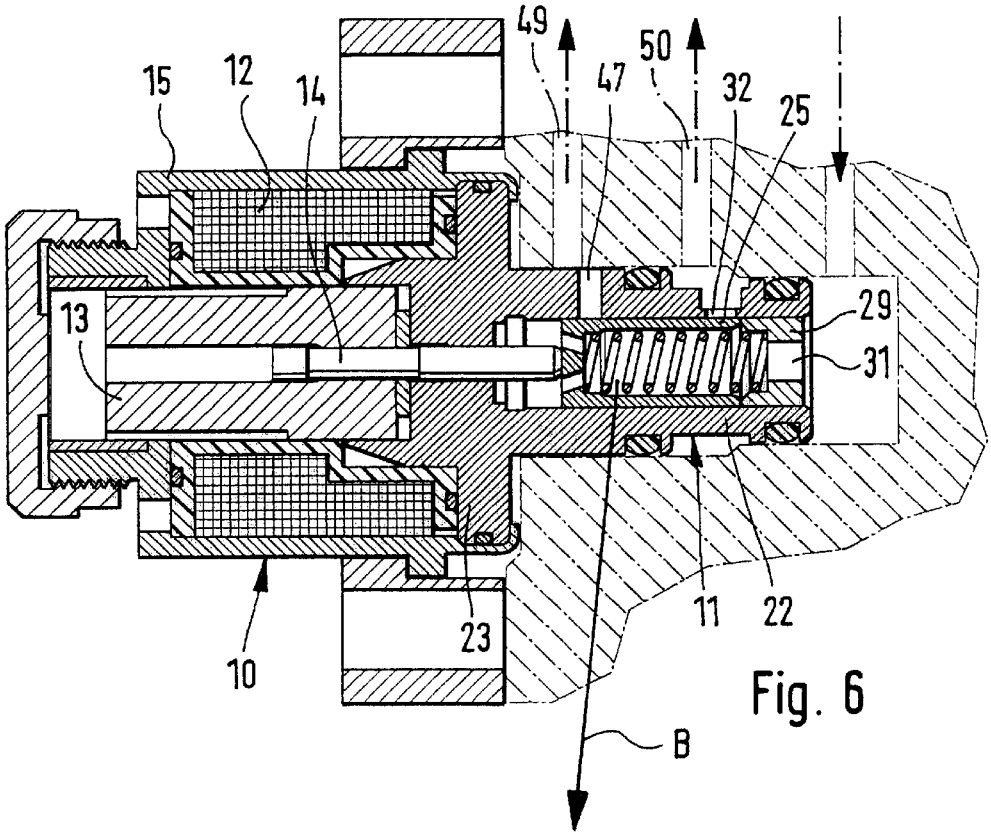
FIG. 6, a variation of the embodiment of FIG. 1 of a fuel metering unit, in vertical longitudinal section.
Figure 7:
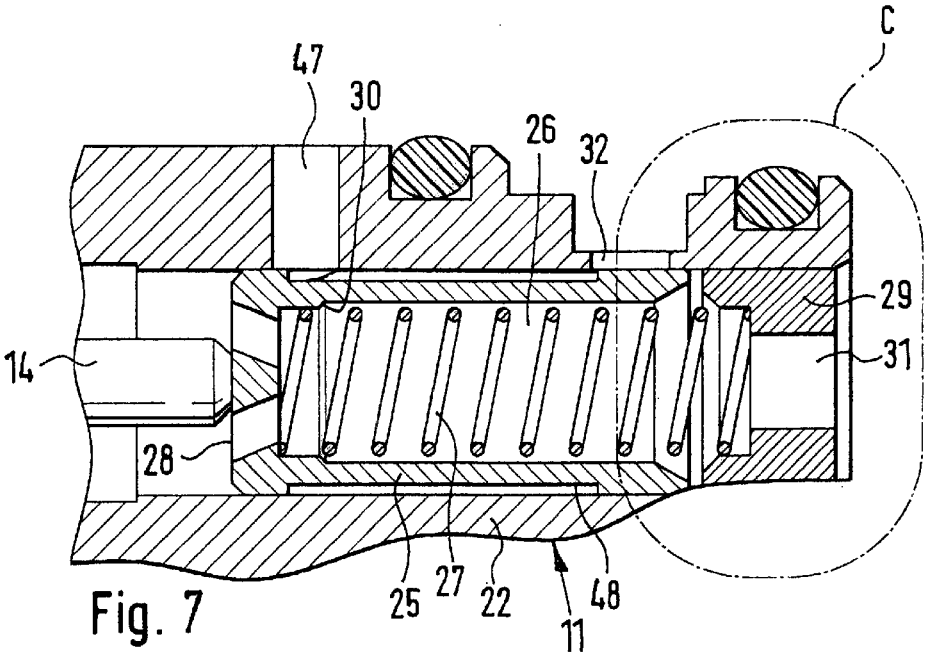
FIG. 7, a portion of from FIG. 6, shown on a larger scale.
Figure 8:
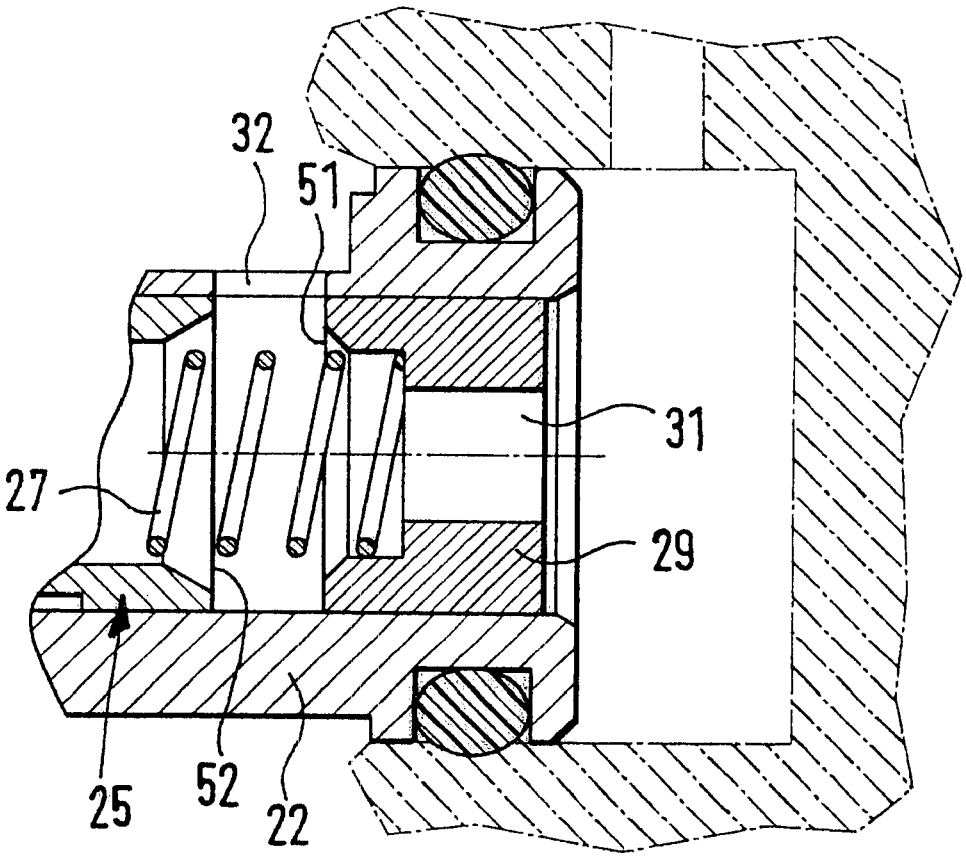
FIG. 8, a modification of section "C" of FIG. 7.

In the overrunning mode of the vehicle, any leaks from the regulating valve 11 must be prevented from causing injections of the high-pressure pump and thus an increase in pressure in the distributor tube (rail) of the fuel injection system. The fuel metering unit 10, 11 must accordingly meet the stringent demands made of this kind of zero feeding situation of the engine. The provisions made for this purpose, which involved a so-called "zero feeding relief", are shown in FIGS. 6, 7 and 8. For the sake of simplicity, components there that correspond structurally and functionally to those in the embodiment of FIG. 1 are identified by the same reference numerals as in FIG. 1.

If zero feeding is desired i.e. substantially maximum current is supplied to electromagnet 10 a further radial bore 47 in the valve housing 22 is opened via the valve piston 25. This open position of the valve piston 25—accomplished by the armature bolt 14 moving counter to the resistance of the compression spring 27, can be seen particularly in FIG. 7. In this valve piston position, the control opening 32 communicates hydraulically with the radial bore 47 via a turned recess 48 on the cylindrical circumference of the valve piston 25. At the same time, the hydraulic communication of the control opening 32 with the compression side of the prefeed pump, inlet 31 of the regulating valve 11, is broken. The radial bore 47 can communicate, through a conduit 49, with the intake side, for instance, of the prefeed pump. As a result of the aforementioned position of the valve piston 25 shown in FIGS. 6 and 7, a hydraulic communication is thus obtained with the intake side of the prefeed pump between the control opening 32 and a conduit 50, leading from there to the high-pressure pump. An undesired pressure buildup upstream of the pump elements of the high-pressure pump and a consequent undesired fuel injection into the combustion chambers of the engine while it is in the overrunning mode is thus advantageously averted.

As an alternative or in addition to the structural characteristics visible in FIGS. 6 and 7 and described above, a zero feeding can also be achieved by the provisions illustrated by FIG. 8. To that end, the rim of the spring plate 29 that faces toward the valve 25 is designed as an axial sealing seat 51, which cooperates sealingly with the end face 52, of the valve piston 25. The annular sealing seat 51 can be embodied for instance as a flat sealing seat of elastomer or as a steel cone seat.

The foregoing relates to a preferred exemplary embodiments of the invention, it being understood that other variants and embodiments thereof are possible within the spirit and scope of the invention, the latter being defined by the appended claims.

We claim:

1. A fuel injection system for internal combustion engines, comprising a distributor tube and a high-pressure pump that is driven as a function of engine rpm and that serves to generate the fuel pressure and throughput required in the distributor tube in the applicable operating state of the engine, and also a fuel metering unit, which is associated with the high-pressure pump, the fuel metering unit being disposed in the high-pressure pump and having a regulating valve actuated by an electromagnet, the regulating valve comprising a valve housing (22) provided with an inlet communicating with the compression side of a prefeed pump and an outlet discharging into the low-pressure region of the high-pressure pump, the regulating valve further comprising a valve piston (25), which is biased by a compression spring (27) to an open position and which is movable to a closed position by an armature bolt (14) of the electromagnet, the electromagnet including a housing and the regulating valve axially adjoins the housing of the electromagnet, the regulating valve housing having an end face with an axial opening (31), at least one radial control opening (32, 34, 35) being disposed in a wall of the valve housing (22) and being exposed by movement of the valve piston, the movement of the valve piston being divided into two distinct regions, the at least one radial control opening being shaped and/or disposed such that during one region of the stroke of the valve piston, the opening area of the control opening which is exposed changes slowly, and in the other region of the stroke of the valve piston the opening area of the control opening which is exposed changes more rapidly and the axial opening in the end face of the valve housing communicating with one of the compression side of a prefeed pump and the low-pressure region of the high-pressure pump and the at least one control opening communicating with the other of the compression side of a prefeed pump and the low-pressure region of the high-pressure pump.

2. The fuel injection system of claim 1, wherein at the onset of the valve piston stroke, the first control region of the control openings (32, 34 35) is provided which is associated with idling and lower partial load of the engine, and as the valve piston stroke continues the second control region of the control openings is provided which is associated with the partial load and full load of the engine, are provided.

3. The fuel injection system of claim 2, wherein the at least one control opening (32, 34, 35) is arranged such that its opening area, plotted over the valve piston stroke, has a shallow characteristic curve (37) with a low slope angle in the first control region, and a steep characteristic curve (38 or 39 or 40) with a high slope angle in the second control region.

4. The fuel injection system of claim 1, wherein the electromagnet is designed so that it has a characteristic curve (41–44) of positioning of the armature bolt in response to the current flowing through the electromagnet (10) is designed to be opposite to the characteristic curve (45) of the compression spring (27) that acts on the valve piston (25).

5. The fuel injection system of claim 1, wherein the electromagnet (10) is triggered in pulse width modulated fashion by a fuel pressure sensor disposed in the distributor tube.

6. The fuel injection system of claim 1, wherein the valve piston (25) is generally sleevelike in shape and in its interior (26) receives the compression spring (27) which urges the valve piston towards its open direction, and that the compression spring (27) is braced toward its rear on a spring plate (29) disposed in a bore (24) of the valve housing (22).

7. The fuel injection system of claim 6, wherein the regulating valve (11) is adjustable by suitable axial displacement and ensuing fixation of the spring plate (29) in the valve bore (24).

8. The fuel injection system of claim 1, wherein the entire fuel metering unit (10, 11) is integrated directly within the high-pressure pump, by a screw thread connection, and that both the regulating valve (11) and the electromagnet (10) are fuel-flooded.

9. The fuel injection system of claim 8, wherein the coil (12) of the electromagnet (10), is housed in a cup-shaped magnet housing (15), and is completely spray-coated with a plastic jacket (17).

10. The fuel injection system of claim 1, wherein the valve piston (25), on its cylindrical circumferential surface, has a turned recess (48), and a radial bore (47) communicating with the intake side of a prefeed pump, and is disposed in the valve housing (22) in such a way that in the closed position of the valve piston (25), the control openings (32) communicate hydraulically, through the turned valve piston recess (48), with the radial bore (47) in the valve housing (22).

11. The fuel injection system of claim 6, wherein the spring plate (29) includes a rim oriented toward the valve piston (25), said rim having an axial sealing seat (51), and said valve piston having a rim which faces toward the spring plate (29).

12. The fuel injection system of claim 7, wherein the spring plate (29) includes a rim oriented toward the valve piston (25), said rim having an axial sealing seat (51), and said valve piston having a rim which faces toward the spring plate (29).

* * * * *

UNITED STATES PATENT AND TRADEMARK OFFICE

CERTIFICATE OF CORRECTION

PATENT NO. : 6,446,606 B1 
DATED : September 10, 2002
INVENTOR(S) : Erwin Krimmer et al.

It is certified that error appears in the above-identified patent and that said Letters Patent is hereby corrected as shown below:

Title page,
Item [75], should read as follows:
-- [75] Inventors: Erwin Krimmer, Pluederhausen; Rainer Haeberer, Bretten; Helmut Clauss, Eberdingen; Tilman Miehle, Kernen; Felix Landhaeusser, Wernau; Markus Rueckle, Stuttgart; all of (DE) --

Signed and Sealed this

Seventeenth Day of December, 2002

JAMES E. ROGAN
*Director of the United States Patent and Trademark Office*